United States Patent [19]

Verbeek et al.

[11] 4,112,331

[45] Sep. 5, 1978

[54] DEVICE FOR IMPROVING THE EFFICIENCY OF A LOW-PRESSURE SODIUM VAPOR DISCHARGE LAMP

[75] Inventors: Thomas Geert Verbeek; Robertus Laurentius Clemens de Vaan, both of Eindhoven, Netherlands

[73] Assignee: U.S. Philips Corporation, New York, N.Y.

[21] Appl. No.: 859,059

[22] Filed: Dec. 9, 1977

Related U.S. Application Data

[63] Continuation of Ser. No. 699,342, Jun. 24, 1976, abandoned.

[30] Foreign Application Priority Data

Jun. 30, 1975 [NL] Netherlands ..... 7507734

[51] Int. Cl.[2] ..... H05B 37/02; H05B 41/392

[52] U.S. Cl. ..... 315/125; 315/127; 315/158; 315/159; 315/208

[58] Field of Search ..... 315/112, 117, 125, 127, 315/158, 159, 208

[56] References Cited

U.S. PATENT DOCUMENTS 4,001,633 1/1977 Van Tongeren et al. ..... 315/117 X

OTHER PUBLICATIONS

Philips Technical Review, vol. 2, No. 12, Dec. 1937; pp. 353–360, by E. G. Dorgelo & P. J. Bouma.

*Primary Examiner*—Alfred E. Smith
*Assistant Examiner*—Charles F. Roberts
*Attorney, Agent, or Firm*—Frank R. Trifari; Bernard Franzblau

[57] ABSTRACT

A low-pressure sodium vapor discharge lamp and a current stabilizing ballast element are connected in series to an energy source so that the lamp is operated by means of a non-sinusoidal current. The temperature of the wall of the discharge tube is maintained in an accurately defined interval and the instantaneous current density in the tube is kept below a first given value and the effective current density is kept above a second given value. This results in a relatively high luminous efficacy.

13 Claims, 2 Drawing Figures

DEVICE FOR IMPROVING THE EFFICIENCY OF A LOW-PRESSURE SODIUM VAPOR DISCHARGE LAMP

This is a continuation of application Ser. No. 699,342, filed June 24, 1976 now abandoned.

The invention relates to a device provided with a low-pressure sodium vapour discharge lamp and with a current stabilizing ballast element connected in series therewith, the lamp containing a discharge tube which contains, in addition to sodium, a rare gas. The lamp is provided with a coating which envelops the discharge tube for the main part and which reflects infra red radiation, the effective temperature T of the wall of the discharge tube being between 245° C. and 270° C. in the operating condition of the lamp.

In this respect the effective temperature of the wall of the discharge tube must be understood to mean that wall temperature which results in the same voltage-current characteristic of the discharge tube as would occur when the discharge tube had the same temperature all over.

In a known device of the type indicated in the preamble the lamp is supplied with an electric current whose instantaneous value is substantially sinusoidal as a function of time. A disadvantage of this known device is that the luminous efficacy of the lamp is relatively low.

It is an object of the invention to mitigate this disadvantage but in a way that will not result in a considerable reduction of the effective electric current through the lamp.

A device according to the invention is provided with a low-pressure sodium vapour discharge lamp and with a current stabilizing ballast element connected in series therewith, in which the lamp comprises a discharge tube which contains sodium and a rare gas. The lamp is provided with a coating which envelops the discharge tube for the greater part and which reflects infra red radiation. The effective temperature T of the wall of the discharge tube is between 245° C. and 270° C. in the operating condition of the lamp. The device is characterized in that — with the exception of any peak current having a duration smaller than 0.5 msecond — the instantaneous current density in the discharge tube is kept below the value $S = 165 + 1.3\,(T - 245)^2$ mA/cm$^2$ and the effective current density in the discharge tube is kept above the value 0.8 S mA/cm$^2$.

An advantage of a device according to the invention is that the luminous efficacy of the lamp is relatively large. Also the effective current through the lamp need not be smaller than in the case of the known device which shows a sinusoidal variation of the lamp current.

The invention is based on the recognition that large current densities in the discharge tube, which occur in the known device around the tops of the sinusoidal lamp current, should be avoided.

The inventors have found that at the indicated large current densities the sodium concentration near the axis of the discharge is so low that the discharge is effected for a large part by means of the rare gas. However, this is a discharge having a relatively small luminous efficacy.

In a device according to the invention a low-pressure sodium vapour discharge lamp is therefore operated with current densities which do not exceed a given maximum value S. The parameter S, which depends on the temperature of the discharge tube, is the value above which the efficiency of the generation in light is relatively low. The requirement that the effective current density in the discharge tube should be above the value 0.8 S is correlated with the fact that to obtain a large luminous efficacy the effective current density should not be too far below the value S.

It should be noted that the requirements imposed on the current density can be satisfied by means of a direct current of a suitable value. Feeding a low-pressure sodium vapour discharge lamp with direct current is indeed known per se, for example, from the article "The sodium lamp", Philips Technical Review, December 1937, pages 353 to 360 inclusive, but there it does not relate to lamps which are provided with an infra-red radiation reflecting coating.

The temperature interval between 245° C. and 270° C. corresponds to sodium vapour pressures between approximately $1.24 \times 10^{-3}$ Torr and $4 \times 10^{-3}$ Torr. This is a pressure interval at which the light generation can be effected with the highest efficiency.

A low-pressure sodium vapour discharge lamp in a device according to the invention may have, or may not have, a separate heating element. If no separate heating element is present, substantially exclusively the generation of heat due to the discharge current must result in the wall of the discharge tube assuming a temperature in the indicated interval of between 245° C. and 270° C. If a heating element is present the combination of the heat generation of the discharge current and the heat generation of the heating element must result in a temperature of the discharge tube wall in the indicated interval. It is also conceivable that the device according to the invention is, for example, arranged in a closed luminair so that then the required temperature of the discharge tube wall can be obtained with relatively low current densities. Further possibilities are found in the quality of the heat insulation, for example by enveloping the discharge tube not only by one infra-red radiation reflecting coating but by a plurality of such coatings.

A device according to the invention may, for example, consist of a resistor arranged in series with a low-pressure sodium vapour discharge lamp, this series circuit being connected to a dc voltage source whose output voltage is carefully kept constant.

In a preferred embodiment of a device according to the invention, which is destined for connection to an ac voltage source, a rectifier bridge is present and the series arrangement of the lamp and the ballast element interconnects two output terminals of the rectifier bridge, those output terminals also being interconnected via a capacitor.

An advantage of this preferred embodiment is that the lamp may be supplied with a current which results in a high luminous efficacy and that the device may also be connected to an ac voltage supply available in many places. The capacitor ther serves to smooth ripples in the dc current supply of the lamp.

It is conceivable that if the effective value of the supply voltage is subjected to variations, compensation therefor can be found in the manner indicated hereinafter. For this purpose an auxiliary device should be connected across the lamp in such a way that when the lamp current exceeds a given threshold value, the magnitude of the resistance of the ballast connected in series with the lamp is changed. This would then be a control in which for an increase of the amplitude of the input ac voltage, the ballast resistance is increased. It is also conceivable that such a compensation device does not act on the voltage across the lamp but on the intensity of the current through the lamp.

In a further preferred embodiment of the device according to the invention, intended for connection to an electric supply source which supplies a sinusoidal ac voltage, the lamp is shunted by an auxiliary branch which comprises a switching element and a resistor, the switching element being periodically closed at instants at which the instantaneous current density in the discharge tube threatens to exceed the value S.

It is an advantage of this device that it can be connected to an ac voltage supply without necessitating the use of a rectifier arrangement. The method underlying this preferred embodiment is that the tops of the sinusoidal current are cut off, namely by making conductive shunting branch across the lamp at the moment that such a current top threatens to flow through the lamp. The result is that then the maximum instantaneous current density in the lamp then remains below the S value.

The switching element in the branch which shunts the lamp may, for example, be a controlled semi-conductor switching element, for example a switching element having a bidirectional thyristor characteristic ("Triac"). It might, for example, also consist of two thyristors connected in anti-parallel.

In a further improvement of said last preferred embodiment of a device according to the invention, the switching element is a light-sensitive switching element and the ballast element in series with the lamp is a coil, an auxiliary lamp associated with the light-sensitive switching element being connected between two taps of the coil.

An advantage of this further improvement is that the shunting branch of the lamp becomes conductive at the proper instant in a very simple manner. For, if the instantaneous current strength through the relevant windings of the coil would exceed a given value, the auxiliary lamp will radiate so much light onto the light-sensitive switching element that the latter can become strongly conductive so that the shunting branch starts carrying a current. Then the total supply current no longer paasses through the lamp. If then, a short moment later, the voltage between the input terminals of the device has fallen, the current strength in the ballast coil also will decrease again and consequently also the voltage to which the auxiliary lamp is connected. This causes less light to fall on the light-sensitive switching element and the shunting branch of the lamp will again assume a high resistance. This means that the current which is taken from the supply will again flow substantially completely through the lamp.

The invention will be further explained with reference to the drawing in which.

Figure 1:
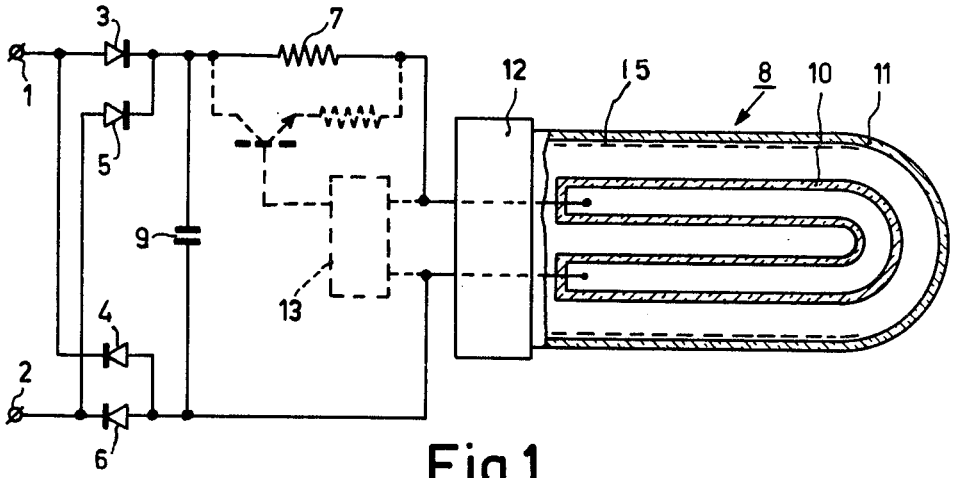
FIG. 1 shows a first device according to the invention.

In FIG. 1 references 1 and 2 are terminals intended for connection to an ac voltage supply. Terminal 1 is connected to a rectifier 3. A rectifier 4 is also connected to the therminal 1. Two rectifiers have also been connected to the terminal 2, namely 5 and 6. The rectifiers 3 to 6 inclusive constitute a rectifier bridge. The output terminals of this bridge are interconnected on the one hand by means of a series arrangement of a resistor 7 and a low-pressure sodium vapour discharge lamp 8 and on the other hand by means of a capacitor 9. The elements 1–7 and 9 provide a means for supplying an operating current to the tube so that its instantaneous current density is kept below the defined value, S. The lamp 8 has a U-shaped discharge tube 10 which is enveloped by an outer bulb 11. The discharge tube 10 comprises, besides sodium, a rare gas consisting of 5.5 Torr Neon to which 1% Argon has been added. Reference numeral 12 indicates a lamp cap. The inner side of the outer bulb 11 is provided with an infra-red reflecting coating consisting of indium oxide. This coating is indicated by means of a dashed line 15. The length of the lamp is approximately 110 cm and the diameter is approximately 6.5 cm.

In one embodiment the effective voltage between the terminals 1 and 2 was approximately 220 Volts, 50 Hertz. The resistor 7 was approximately 12 Ohms. The capacitor 9 had a capacitance of approximately 250 micro Farad. Reference 8 was a sodium lamp of approximately 180 Watt. The diameter of one leg of the discharge tube 10 was approximately 19 mm. This means that the cross-sectional area of such a leg is approximately 2.8 $cm^2$. In the embodiment shown the lamp voltage was approximately 280 Volts and the lamp current strength approximately 0.65 A. The effective temperature of the wall of the discharge tube 10 was approximately 254° C. The lamp delivered a luminous flux of approximately 37800 lumen. This implies a luminous efficacy of approximately 210 lumen/Watt.

When the low-pressure sodium vapour discharge tube indicated in FIG. 1 reference 8 is fed by means of a sinusoidal alternating current, i.e. in a manner which is according to the invention, the effective current strength being the same as in the case described with reference to FIG. 1, the luminous efficacy is lower than in the case of the invention. In the case of the invention the luminous efficacy is approximately 15% higher than for the supply with the sinusoidal alternating current.

If the effective input voltage between the terminals 1 and 2 of the device of FIG. 1 is insufficiently constant, use may, for example, be made of the dotted auxiliary device 13 by means of which the magnitude of the ballast can be changed by means of a transistor and as a function of the voltage across the lamp.

Figure 2:
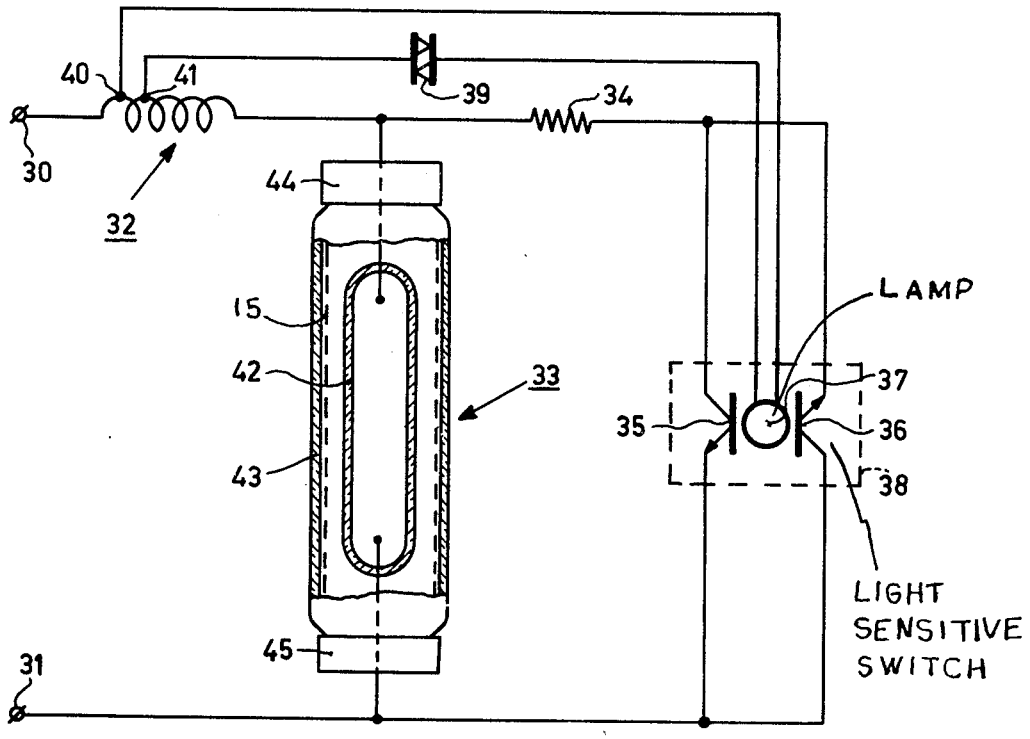
FIG. 2 shows a second device according to the invention.

References 30 and 31 in FIG. 2 indicate input terminals intended for connection to a supply source which delivers a sinusoidal ac voltage of 380 Volts, 50 Hertz. The terminal 30 is connected to a stabilizing ballast 32 which is constructed as a coil. The other side of the coil 32 is connected to a low-pressure sodium vapour discharge lamp 33. The other side of the lamp 33 is connected to the terminal 31. The lamp 33 is shunted by a series arrangement of a resistor 34 with two light-sensitive transistors 35 and 36 which are connected in anti-parallel. The transistors 35 and 36 are incorporated in a light-tight compartment 38 together with an auxiliary lamp 37. The auxiliary lamp 37 is connected between two taps 40 and 41 of the coil 32 via a bidirectional-breakdown element 39. The breakdown element 39 is a "Diac".

The lamp 33 comprises a discharge tube 42 which is enveloped by an outer bulb 43. The innerside of the outer bulb 43 comprises an infrared-radiation reflecting coating which is indicated by means of a dashed line 15. This coating consists of indium oxide. References 44 and 45 indicate end parts of the lamp 33.

The device shown in FIG. 2 operates as follows. If the terminals 30 and 31 are connected to the source of sinusoidal current, a current flows through the lamp 33 via the ballast 32. If, however, the instantaneous current strength increases to above a given value, a voltage is developed between the terminals 40 and 41 which exceeds the breakdown voltage of the element 39. Thereupon the lamp 37 starts to emit light. It illuminates the two transistors 35 and 36 which consequently become conductive. Depending on the polarity of the supply voltage one of the transistors will provide a current-carrying shunt branch across the lamp 33 via the resistor 34. This means that when the instantaneous current strength through the lamp 33 threatens to exceed a given maximum value, an auxiliary current starts flowing through the shunt branch 34, 35 or 36, 34 respectively. The device is so adjusted that this occurs if the maximum instantaneous current density in accordance with the requirements indicated threatens to be exceeded. In one embodiment the lamp 33 is a lamp of approximately 175 Watt and the impedance of the coil 32 is approximately 0.96 Henry. The effective temperature of the discharge tube 42 of the lamp 33 is again approximately 254° C. in the operating condition.

In the case of FIG. 1 the maximum instantaneous current density through the discharge tube is approximately 230 mA/cm$^2$. This is below the value $S = 165 + 1.3\ (T - 245)^2 = 270$ mA/cm$^2$. The effective current density is also approximately 230 mA/cm$^2$. This is more than $0.8\ S = 216$ mA/cm$^2$.

In the case of FIG. 2 the maximum instantaneous current density through the discharge tube is adjusted to 260 mA/cm$^2$. This is below the value $S = 165 + 1.3\ (T - 245)^2 = 270$ mA/cm$^2$. The effective current density through the discharge tube 33 is approximately 230 mA/cm$^2$. This is more than $0.8\ S = 216$ mA/cm$^2$.

What is claimed is:

1. An illumination device comprising, a low-pressure sodium vapour discharge lamp and a current-stabilizing ballast element connected in series therewith, the lamp including a discharge tube which contains sodium and a rare gas, the lamp being provided with an infrared radiation reflecting coating which envelops a large part of the discharge tube whereby in the operating condition of the lamp the effective temperature T of the discharge tube wall is maintained between 245° C. and 270° C., and means for supplying an operating current to the tube so that — with the exception of any peak current having a duration smaller than 0.5 msec — the instantaneous current density in the discharge tube is kept below the value $S = 165 + 1.3\ (T - 245)^2$ mA/cm$^2$ and the effective current density in the discharge tube is kept above the value 0.8 S mA/cm$^2$.

2. A device as claimed in claim 1 wherein said means for supplying operating current includes a pair of input terminals adapted for connection to an ac voltage source, a rectifier bridge having input terminals connected to said pair of input terminals and output terminals connected to the series arrangement of the lamp and the ballast element, and a capacitor connected across the output terminals of the rectifier bridge.

3. A device as claimed in claim 1, intended for connection to a source of sinusoidal AC voltage, wherein said means for supplying operating current comprises an auxiliary branch connected in shunt with the lamp and comprising a switching element and a resistor, and means for periodically closing the switching element at instants at which the instantaneous current density in the discharge tube approaches the value S.

4. A device as claimed in claim 3, characterized in that the switching element comprises a light-sensitive switching element and that the ballast element in series with the lamp comprises a coil, said device further comprising an auxiliary lamp optically coupled with the light-sensitive switching element and connected between two taps of the coil.

5. Apparatus for operating a sodium vapor electric discharge tube comprising, a pair of input supply terminals for connecting a source of electric energy to the apparatus, a ballast element having an impedance value sufficient to stabilize the tube operating current and connected in series with the discharge tube across said pair of input supply terminals, heating means enveloping a large part of the discharge tube and operative to help maintain the wall of the discharge tube at an effective temperature T between 245° and 270° Centrigrade during tube operation, and means including said heating means for maintaining, except for peak currents of less than 0.5 msec duration, the instantaneous current density in the discharge tube below the value $S = 165 + 1.3\ (T - 245)^2$ mA/cm$^2$ and the effective current density therein above the value 0.8 S mA/cm$^2$.

6. Apparatus as claimed in claim 5 wherein the discharge tube comprises a low pressure sodium vapor discharge tube and said heating means includes a layer of infrared radiation reflecting material electrically isolated from the input terminals and enveloping the discharge tube and transparent to visible radiation.

7. Apparatus as claimed in claim 5 further comprising means responsive to the discharge tube current for altering the impedance of the ballast element as a function of said tube current.

8. Apparatus as claimed in claim 5 wherein the input supply terminals are adapted to be connected to a sinusoidal AC energy source and said current density maintaining means further comprises means for modifying the wave form of the electric energy applied to the discharge tube so as to supply a non-sinusoidal operating current for the discharge tube.

9. Apparatus as claimed in claim 8 wherein said waveform modifying means comprises, an impedance element, a current control element, means connecting said impedance element and said current control element in a branch circuit connected in shunt with the discharge tube, said current control element being operative to allow current to flow through said impedance element at the tops of the AC current supplied by said energy source.

10. Apparatus as claimed in claim 9 wherein the ballast element comprises an inductor and the current control element comprises a light-sensitive switching element and a light source optically coupled to the switching element and electrically coupled across a part of said inductor.

11. Apparatus as claimed in claim 10 further comprising a voltage breakdown element electrically coupling the light source to the inductor.

12. Apparatus as claimed in claim 8 wherein the discharge tube comprises a low pressure sodium vapor discharge tube and said heating means includes a layer of infrared radiation reflecting material enveloping the discharge tube.

13. An improved method of operating a low pressure sodium vapor discharge tube which comprises, providing a part of the discharge tube with a layer of infrared radiation reflecting material, connecting the discharge tube to a source of electric energy, maintaining the wall of the discharge tube at an effective temperature T between 245° and 270° Centrigrade, and supplying operating current to the tube so that, except for peak currents of less than 0.5 msec duration, the instantaneous current density in the discharge tube is below the value $S = 165 + 1.3\ (T - 245)^2$ mA/cm$^2$ and the effective current density in the tube is above the value 0.8 S mA/cm$^2$.

* * * * *

UNITED STATES PATENT AND TRADEMARK OFFICE

CERTIFICATE OF CORRECTION

PATENT NO. : 4,112,331

DATED : September 5, 1978

INVENTOR(S) : Thomas Geert Verbeek, et al

It is certified that error appears in the above-identified patent and that said Letters Patent are hereby corrected as shown below:

Column 1, line 68, after "efficiency" delete "of" and insert --in--, also after "generation" delete "in" and insert --of--.

Column 2, line 56, delete "ther" and insert --then--.

Signed and Sealed this

*Thirteenth* Day of *May 1980*

[SEAL]

*Attest:*

SIDNEY A. DIAMOND

*Attesting Officer*

*Commissioner of Patents and Trademarks*